US008087247B2

(12) United States Patent
Graf

(10) Patent No.: US 8,087,247 B2
(45) Date of Patent: Jan. 3, 2012

(54) HEAT ENGINE/ HEAT PUMP USING CENTRIFUGAL FANS

(76) Inventor: Ronald Edward Graf, WinstonSalem, NC (US)

( * ) Notice: Subject to any disclaimer, the term of this patent is extended or adjusted under 35 U.S.C. 154(b) by 488 days.

(21) Appl. No.: 12/291,148

(22) Filed: Nov. 7, 2008

(65) Prior Publication Data

US 2010/0115946 A1 May 13, 2010

Related U.S. Application Data

(63) Continuation-in-part of application No. 12/152,437, filed on May 15, 2008, now Pat. No. 7,874,175.

(51) Int. Cl.
*F01K 25/02* (2006.01)

(52) U.S. Cl. ..... 60/650; 60/682; 60/683

(58) Field of Classification Search ..... 60/650, 60/682–683

See application file for complete search history.

(56) References Cited

U.S. PATENT DOCUMENTS

| | | | | |
|---|---|---|---|---|
| 4,002,033 | A * | 1/1977 | Welch | 60/682 |
| 5,642,620 | A * | 7/1997 | Bakker | 60/682 |
| 5,722,229 | A * | 3/1998 | Provost | 60/785 |
| 5,873,250 | A * | 2/1999 | Lewis et al. | 60/650 |

* cited by examiner

*Primary Examiner* — Hoang Nguyen

(57) ABSTRACT

An engine/heat pump is shown. Most of its parts rotate around the same central axis. It comprises two doubly connected chambers. Blades in each chamber substantially rotate with the chamber and may be firmly attached to the walls of the chamber, thus forming a modified centrifugal pump with axial input and discharge. An expandable fluid is rotated outward by one of the pumps and then heat is added for an engine or removed for a heat pump as the fluid is being sent to the outer part of the second pump. The fluid travels toward the center of the second pump, thus impelling the pump in the rotation direction. Then heat is removed for an engine or added for a heat pump as the fluid leaves the second pump and travels back to the first pump near the center of rotation. Rotation energy of the fluid is typically much larger than the circulation energy. A modified centrifugal pump with axial discharge having a casing rotating with the blades is also claimed.

11 Claims, 2 Drawing Sheets

HEAT ENGINE/ HEAT PUMP USING CENTRIFUGAL FANS

CROSS-REFERENCE TO RELATED APPLICATIONS

The present invention is a continuation-in-part of U.S. patent application Ser. No. 12/152,437, filed May. 15, 2008 now U.S. Pat. No. 7,874,175 by the same inventor.

FEDERALLY SPONSORED RESEARCH

Not Applicable

JOINT RESEARCH PARTIES

Not Applicable

REFERENCE TO A "SEQUENCE LISTING", A TABLE, ETC

Not Applicable

BACKGROUND OF THE INVENTION

1. Field of the Invention

Broadly, the field is external heat engines, which can also be redesigned and used as heat pumps. Within this category die field is external heat engines or heat pumps comprising what might be described as a part of a centrifugal fan acting as a compressor and a second centrifugal fan operated backwards and acting as an expander. When I Say fan I am actually talking about a compressor or an expander. The fan part may differ from conventional centrifugal fans, because the output may be directed with a substantial axial component directed toward the other fan, as opposed to almost entirely tangential output for a standard centrifugal fan. The engine fans also differ from conventional fans in that when the engine is idling, the output of either fan may be zero. In some embodiments, there is an unstable equilibrium when the fluid is merely rotating with the engine as a whole. The engine power output is associated with the circulation of the working fluid relative to the rotating engine. The best versions of the engine are rotating. The circulation produces velocity changes producing pressure and temperature changes due to that circulation and rotation. The rotation of the engine amplifies the effects of the circulation. One embodiment of the invention could be looked at as two substantially centrifugal compressors connected so that the conventional input of one is connected to the conventional input of the other and the conventional output of one is connected to the conventional output of the other. Thus during operation the flow in one compressor is in the reverse of the conventional direction: whereas the flow in the other compressor is in the conventional direction. A substantially centrifugal compressor is a compressor having a rotor or impeller. It may also contain elements of radial compressors. It may also contain other elements, such as flow expanders.

2. Description of Related Art

There are many external heat engines that expand and contract a working fluid. One of my favorites is the Stirling engine which uses a large piston to oscillate the fluid between being cooled and being heated. The oscillation of temperature is caused by sending it through a regenerator and having a heat source on one side and a cooling source on the other side of the regenerator. The power output piston is synchronized out of phase with the oscillator piston. There is friction and pressure loss at both pistons. My invention requires no piston and no chamber that changes volume. Also a regenerator, which causes power loss, is not necessary.

Other engines use a compressor followed by an expander, but then open to the atmosphere. The closest to my invention use centrifugal compressors, similar to axial compressors that push the fluid along the rotation axis of an impeller. A jet engine for example is an internal combustion engine that can use a compressor up front. The impeller moves with respect to its housing. This produces energy loss even when the engine is only idling. It also may produce loss of the working fluid depending on how the impeller shaft is introduced. It may also cause problems when the blades move faster than the speed of sound with respect to the casing in which they reside.

My invention, in its preferred form has essentially no working fluid loss. It also has essentially no energy loss when idling, since there are no parts moving with respect to each other, except at the rotating axle outside the fluid containers. Even the working fluid is almost not moving with respect to its container. Even when the engine is going at full speed, the only sound speed problems would be between the rotating casing and a surrounding container. When idling my engine acts like the child's toy, a rotating top. Also the engine has no moving seals contacting the working fluid, thus requiring no lubrication. The engine has no seals at all, except for lubrication on the axle of the engine. It should last nearly forever with no maintenance.

The most closely related art would be centrifugal compressors, since my invention combines two of these, but the output of each is not tangential and the output of one is at the fan area closest to the axis of rotation. Thus an expansion fan is operated like a compressor in reverse, receiving input far from the axis and expelling output very near the axis. To get a larger difference in pressure between the input and output of the compression fan, the spiral as it goes from the center to the outside can be retrograde (counter to the rotation direction). If retrograde, the normal to the surface that pushes the working fluid has a positive radial component. The larger the pressure ratio, the larger the temperature ratio can be and thus the larger the theoretical efficiency of the engine. The current limits of die compression ratio on centrifugal compressors is about ten to one, when pushing air. External heat will be added after the compression, when the fluid is substantially furthest from the axis of rotation.

Actually the engine does not use a purely centrifugal fan, because after the working fluid almost reaches the extreme distance from the rotation axis, for best efficiency, it must be expelled more nearly parallel to the rotation axis, so it can be directed to the second centrifugal fan, which will act as an expander producing power. The impellers may be partially twisted to accomplish the expulsion of the working fluid in a direction nearly parallel to the rotation axis. Also the fan compartment may be shaped so that the fluid first is traveling away from the other fan but at the time to exit the fan it is traveling more toward the other fan. Thus the fan is a cross between a radial fan and an axial fan and the fan compartment is warped to be more like the curved surface of a half of a sliced bagel. Also each impeller may spiral further from the axis on the side closer to the other fan than on the side further from the other fan, thus allowing a radial component in the velocity as it leaves the fan. Of course there is a large tangential component in inertial space, but not relative to the working fluid container. In a conventional centrifugal fan the output fluid is usually expelled perpendicular to the rotation axis.

The heat cycle of the preferred engine of this invention is as follows. The working fluid goes through adiabatic compression, followed by adding heat far from the rotation axis causing some expansion, followed by adiabatic expansion in a reverse compressor, followed by cooling close to the rotation axis causing some contraction, then repeat often. Ideally, the compression and expansion parts of the cycle are performed adiabatically (no heat added or subtracted from the working fluid). Actually some heat exchange with the chamber may take effect. According to formulas for adiabatic compression, the temperature ratio for a monatomic gas is closer to the pressure ratio than it is for a gas consisting of multiple atoms per molecule. The multiple atoms supply more degrees of freedom and thus more capacity to store the heat caused by the compression. This higher temperature ratio is important for engine efficiency.

Ideally the blades of the centrifugal fans meet the fluid so that the fluid is traveling in a direction parallel to the blade surface just before contact and just after leaving each blade. Each blade may be replaced by several blades at varying distances from the axis. Ideally, for maximum efficiency the pressure difference in each fan is maximized producing the largest temperature ratio possible. The extreme pressure ratio on centrifugal compressors for air is currently about 10:1. At ratios above ten for air the compressor may wear out fast and may be dangerous. There is less problem with a heavier gas such as argon or krypton. A ratio of 5:1 would be adequate for very good efficiency and reduced risk and reduced energy loss within the engine. Other reasons to reduce the pressure ratio will be discussed later.

Of course, the compressor and expander can be made similar to modern compressors in that the fluid in the compressor can be centrifuged by a central rotator and rammed into a set of stationary channels to increase pressure. The fluid would then be sent into the stationary channels for the expander. However, this would dramatically increase flow pressure losses because of high velocity in the stationary parts of the compressor and expander. It would also increase losses due to swirl of the fluid, since fluid angular momentum is increased in the early stage of the compressor and later brought to almost zero in the second stage of the compressor. The fluid angular momentum has to then be brought up again before the fluid is introduced to the outer part of the expander. It is better to rotate the paths from compressor to expander and expander to compressor as is done in my preferred embodiment.

One object of the current invention was to produce an engine/heat pump which, when operating at a steady speed, has no changes in temperature at any particular point. Thus heat loss due to changing operating temperatures at a particular position are negligible. Heat loss due to conduction along the parts with spatial temperature differences can be minimized in several obvious ways.

Another object was to produce an engine where there is essentially no loss of pressure around pistons or blades. Prior engines would produce localized circulations and turbulence especially where the blades are close to the blade casing. There is rapid relative motion between closely spaced components in most if not all prior art In my invention the casing which is touched by the working fluid moves with the same rotation rate as the blades, so the blades do not move with respect to the casing, except for angle adjustments.

Another object of the current invention is to produce an engine comprising a centrifugal compressor and a reverse operated compressor in which the working fluid speeds above Mach 1.3 in the compressor are not a problem, because that speed is actually only relative to the outside of the engine. The speed of the working fluid relative to the blades and to the casing used to contain the working fluid is much smaller. The only high relative speeds are between a substantially stationary container outside the rotating parts and the working fluid container together with any container that may be rotating with the engine, maybe to contain a heat supply for heat exchange maybe using a flow of carbon dioxide and nitrogen if a hydrocarbon is burned. The fluid, probably air if present between the rotating and stationary surfaces, will be near atmospheric pressure or below. Also it will be heated and thus the speed of sound is higher in this fluid. In some solar applications, heat of solar radiation is applied directly to the working fluid container and no fluid heat source is necessary. Thus heat would be exchanged between the working fluid and the surface heated by the sunlight, thus heating the working fluid as it travels from compressor to expander far from the rotation axis. A glass container might be used to prevent heat loss to the atmosphere and also to allow evacuation of air surrounding the engine.

Another object is to produce an engine wherein the working fluid can foe at a much higher pressure internally, where the relative motion with respect to the container is small, and wherein the relative motion of the container with respect to the atmosphere can be much larger.

Another object of the invention was to produce an engine with negligible friction loss, since there are no solid parts moving relative to each other due to the engine cycle. Of course, as with most engines, the output shaft is rotating with respect to parts of the device propelled by the engine.

Another object of the invention was to produce an engine that would have no loss of working fluid to the outside or around pistons, since substantially the working fluid is in a container that does not necessarily change shape or volume, except for stress or strain. Argon and krypton gas would not permeate or escape from its enclosure if steel is Used.

Another object of the current invention was to produce an engine which produces very little metal fatigue, since in the rotating system the rotating parts do not move relative to each other during operation and they maintain a nearly constant rotational speed thus keeping stress almost constant.

Another object of the current invention is to produce an engine that loses very little energy while idling at high speed, because the working fluid can be pumping very slowly.

Another object of the current invention is to produce an engine that needs no lubrication, except at the axle. There is no friction wear in the engine.

Another object of the current invention is to produce an engine that needs no seals. The seals could produce a problem in other engines at high temperature.

Another object of the current invention was to produce a very low loss heat pump that allows the temperature ratio to be varied, by varying the rotation speed.

Another object was to produce a heat pump that can be made from aluminum and use argon as the working fluid.

BRIEF SUMMARY OF THE INVENTION

The invention is an external heat engine, which can be modified to serve as a heat pump. The engine consists of a heat exchanger to remove heat, followed in the flow of a working fluid by a substantially centrifugal compressor, which, like all centrifugal compressors comprises an impeller or rotor to urge fluid in a direction with a positive radial component comparable or larger than the axial component. The compressor may be thought of as a centrifugal pump. It is followed by a heat exchanger to add heat. This heat exchanger is followed by another substantially centrifugal compressor used to act as an expander by operating it with flow reversed from that of a conventionally operated centrifugal compressor. This expander's conventional output is actually a fluid input as far as flow is concerned during sustained power production. This expander's conventional input is actually an output as far as flow is concerned. This expander is actually built physically like a centrifugal compressor even though it is operated backwards with respect to flow direction, when die engine is producing power.

In its best design, the engine rotates around an axis and the working fluid also rotates around this axis with substantially the same rotation rate. While rotating around this axis, a motion as follows is superimposed on the fluid. The fluid travels substantially along the axis, near the center of rotation and is cooled by a fluid in a central pipe during this travel. It has been traveling away from what might be described as a first modified centrifugal fan. It enters what might be described as a second modified centrifugal fan. The fluid is compressed by this second fan and expelled at the periphery of this second fan with the superimposed motion (motion relative to the working fluid container) traveling somewhat radially and somewhat along the axis of rotation, but back toward the first fan. The fluid has been heated by compression and further heat is added before the fluid then enters near the periphery of the first fan. The fluid is expanded in this first fan and thus produces torque tending to accelerate the rotation. The fluid leaves tills first fan near its center but traveling toward the second fan. You can call fan one a centrifugal expander and fan two a centrifugal compressor. The expander is just a compressor operated backwards with respect to flow.

The blades of the two fans are attached to the walls of the working fluid container, but the attachment, in some models of the invention, may allow minor rotation with respect to the other rotating parts of the engine around axes substantially parallel to the main rotation axis of the engine. This allows the blades to meet and to release the working fluid at a controlled but variable angle. Rotated blades allow the engine to compensate for the effects of differing speeds by adjusting blade angle so that the fluid always meets each blade substantially parallel to the blade surface. Also, the effects of acceleration and deceleration on flow of the working fluid can be smoothed out by changing blade angle. If blades located at various distances from the rotation axis are used, then the blades further from the axis in the compressor may urge the fluid with a significant axial component toward the expander fan.

The power output of the engine is the net difference between the power input to the compressor and the power output from the expander. Since the fluid is further heated and thus expanded after compression, it is traveling at a faster volume flow rate into the expander than it was flowing leaving the compressor. This allows it to do more Work in the expander than was used in the compressor. Principals of compressor design including expansion of fluid path cross-section to increase pressure difference at the expense of speed apply somewhat. The fluid pressure change rather than flow rate is emphasized at the output from the compressor.

When the engine is started and as rotation speed builds, the fluid, due to its inertia, pushes against the blades. The compressor blades during acceleration help the fluid to take up the relative motion being superimposed on top of the rotation. This relative motion can be helped by a slight bias of blade direction. Assume that the blades of the compressor spiral outward in the opposite direction from the rotation. Then there will be a radially outward component to the force produced by the blades on the working fluid when the engine is accelerating. Similarly, assume that the blades on the expander spiral outward and forward in the direction of rotation. Then there will be a radially Inward component of the force produced by the blades of the expander on the working fluid due to engine acceleration. The outward forces on the fluid in the compressor and the inward forces on the fluid in the expander both produce circulation of the working fluid in the same cycle sense (outward in the compressor and Inward in the expander).

In the previous paragraph only the effects of rotational acceleration were taken into account. Now consider the effects of the fluid circulation combined with the engine rotation. The fluid circulation changes the radial distance of the fluid from the rotation axis in both the expander and the compressor. Assuming the same spirals of the blades as in die immediately preceding paragraph, and assuming engine rotation without acceleration, then in the compressor the blades always are moving faster than the fluid, because the fluid is moving radially outward to where the blades are moving faster. Thus there will be an outward component of force on the fluid due to the blades. There is also the centrifugal force. These two forces add to produce a large pressure change as the fluid moves radially outward through the compressor. In the expander the blades will be moving slower than the fluid as it moves inward to positions where the blades are moving slower than the blade surfaces just left by the fluid. This means that the blade surfaces being hit by the fluid are pointing radially outward, similarly to what happens when the engine decelerates. Thus the blades push die fluid radially outward and add to the centrifugal force which is also pointing radially outward. Thus the pressure ratio from center to outside is increased in the expander. This can match the increased pressure found in the compressor. To maintain circulation while the engine is not changing speed it is important to make the pressure changes favoring circulation slightly larger than those opposing circulation.

If the expander blade spiral is negligible meaning that the blades are flat or almost flat, whereas the compressor blades are spiraled, then the compressor will dominate and maintain the circulation. The compressor will also start the circulation when the engine is accelerated. From a circulation point of view during steady engine output and during acceleration and deceleration it is best to use very little spiral in the expander and compressor. A balance must be struck between increasing engine efficiency by causing larger pressure ratios by spiraling blades and increasing engine stability by using mainly centrifugal forces to produce the large pressure ratios. For some applications, such as solar power, engine speed will not vary much and more pronounced spirals can be used.

In some designs, special blades, which can double as heat exchange fins, can be located within the path from the compressor to the expander to impel the fluid forward when the rotation rate of the fluid must be increased to match the rotation rate of the engine at the entrance to the expander. It may be hard to tell where the compressor blades leave off and the blades along the path to the expander begin. The object is to produce as smooth a flow as possible as the fluid is sent through its cycle and still get a large energy output. Once the relative motion starts, the difference in velocity of points rotating exactly with the engine rotation but further from or nearer to the rotation axis, at various points along the fluid path causes the fluid to push against the blades. This not only tends to increase the flow of the working fluid, but also produces engine output torque.

If the engine which is the subject of this invention is added to and is using the heat output of a first engine, such as a car engine, the engine will probably reduce speed at times as well as increase speed at other times. When the engine rotation speed is reduced, then the working fluid net velocity at a particular point (that velocity which is measured by velocity with respect to the velocity at that point of the engine due to engine rotation around the axis) will tend to reverse direction, thus reversing flow. This happens because the difference between compressor effects and the expander effects which tends to keep the flow going when engine speed is constant, may be overcome by the engine rotation deceleration effects. The fluid may be hitting the blades with less relative motion or hitting the opposite side of the blades in the compressor. Thus the normal to the surface being hit by the working fluid may now be inward rather than outward, thus producing forces on the fluid opposing the centrifugal forces. During deceleration the fluid hits the blades of the expander harder and thus causes increased resistance to the cycling flow.

This tendency to reverse flow can be countered in many ways. The blades can have a variable pitch with respect to the radial direction. This could be accomplished hi many ways, one of which would be to include tiny electrical motors at the edge of the working fluid space to rotate the blades. A single spiral might comprise many blades, though it is not necessary to have the blades along spirals.

Another way to counter die tendency to reverse fluid flow would be to use an external coupling that would not require the engine to slow quickly. This coupling could work with a rotation sensor using a feedback loop. Feedback loops are common in engineering and the stealth bombers would not fly without such a loop to maintain aerodynamic stability. When die engine slowing is detected the coupling to die load would be reduced, thus reducing die engine slowing to a rate that would allow the working fluid to maintain its superimposed flow. If a car were braking, then the coupling would be reduced to almost zero. In a car there would probably be a fluid power coupling anyway. The old method to let die engine idle while die car was not moving was a clutch. The car engine can act like a starter for the engine of this invention. Of course the engine of this invention can work without another engine, but like most engines it needs a starter. A feedback loop for engine slow down is also recommended for most applications. Also means to divert the input heat when engine slowdown is desired would be useful.

Assuming that during optimum performance speeds the temperature along the upper end heat exchanger does not reduce much, say a hundred degrees, then it might be advisable to put a second engine of similar design down stream from the heat source. This would allow the unused upper temperature heat discarded by the first engine of this invention to be used by a second engine of this invention. There may be a series of engines each rotating around the same axis if desired.

Of course unused heat can be routed back to the heat source to improve efficiency of the heat source. This might be used in a solar collector. If the heat were transferred by a fluid flowing in the collector, then the hot flow leaving the engine would be introduced at the cooler end of the collector flow. If the heat source were a light concentrator not using fluid flow, then the heat at the engine heat exchanger May be directly applied to the working fluid container and the unused heat would remain in the skin of the container, thus requiring less sunlight to bring the temperature back up to optimum. Very high efficiency could be attained. Note that in the hot end heat exchanger heat exchange is occurring between the hot skin of the engine and the working fluid.

Heat Pump Aspect

It may be easier to understand how the device works as a heat pump, since there is no extremely variable load. Suppose we have a drum of a compressible fluid rotating. If we now cause fluid to migrate from the center to the periphery of the drum, as would happen in the compressor fan, this fluid will compress thus raising its temperature. If the fluid is now sent back toward the center of rotation, as would happen in the expander fan, the fluid will expand thus cooling. Thus we have a difference between the temperature at the periphery and the temperature near the center of rotation. This temperature difference can be used, assuming heat exchange, as in a heat pump and energy must be added to continue the rotation. The rotation energy must be added, because the fluid is traveling with higher volume flow at the same distance from the rotation axis in the compressor than in the expander, thus making the energy used in the compressor greater than the energy recovered in the expander. As an aside, the opposite was true of the engine. In a heat pump, heat is added after expansion but before compression, because that is how a heat pump works at the cool end. Similarly heat is removed at the warm periphery, just before expansion. The addition and removal of heat affects the volume flow not the mass flow. Volume flow affects fluid speed and thus its momentum change and thus pressure on the blades.

Pressure and Rotation G Force Considerations

The engine or heat pump can be operated with the working fluid held at many atmospheres. It can also be operated at very large rotational G forces. If the compressor is operated near a 7:1 pressure ratio, a large part of that ratio is caused by G forces. Another large part of the pressure ratio is due to the blades pushing the fluid with a radial component. The pushing is caused by inertial effects as the blade tries to increase or decrease the angular momentum of the fluid in the compressor or expander respectively. Most pressure differences are against concave surfaces, which are stable. With proper design, the only pressure difference against an unreinforced convex surface. being therefore unstable, is at a pipe going through the center of the engine parallel to the axis. In one design, tubes through the pipe carrying the coolant may be pressured from the outside of the tubes by the working fluid traveling inside the pipe. In another design the outside of the pipe itself may be pressured from the outside.

The space between the connection between fans where heat is being added and the connection between fans where heat is being removed should ideally be filled with a solid or a reinforced body. Since the working fluid may be at hundreds of atmospheres and the pressure ratio from the close to axis points to the far from axis points may be very large, the borders of the space may need reinforcing like that used in submarines. This space, since it does not need working fluid, should contain a strong material to keep the shape of the space uniform and prevent much working fluid from being wasted in the space. This material can reinforce an impervious wall around the space if desired and can be porous. If desired, the material in this space can be solid and act like a fly-wheel.

A lot of work has been done on the design of centrifuges and energy storing fly-wheels. The safety limits for centrifuges and fly-wheels should be taken into account. Also the engineering aspects of bearings and other critical parts for centrifuges and fly-wheel energy storage systems would be useful knowledge.

Also centrifugal compressor design may be useful, even though they have stationary casing design around the blades, whereas the casing for the blades rotates with the blades in the best designs of the present invention. Also it is more important in the current invention to not have casing parts extending far off the rotation axis, because they are rotating and would have stress proportional to the radius from the rotation axis. It would be possible, but less efficient, to use a centrifugal compressor of stationary casing design and another similar compressor operated backwards. They could be connected so the peripheral output of the compressor travels to the peripheral input of the expander through a heat exchanger that is stationary and not rotating with respect to the casings. A stationary casing design is also covered but not preferred by this Invention.

Beside the engines and heat pumps covered in this invention, there is also a centrifugal pump design in which the casing is moving with the blades. This has the advantage of not becoming clogged with debris, such as rags, which get caught between the blades and stationary casings in older designs.

DETAILED DESCRIPTION OF THE INVENTION

Figure 1:
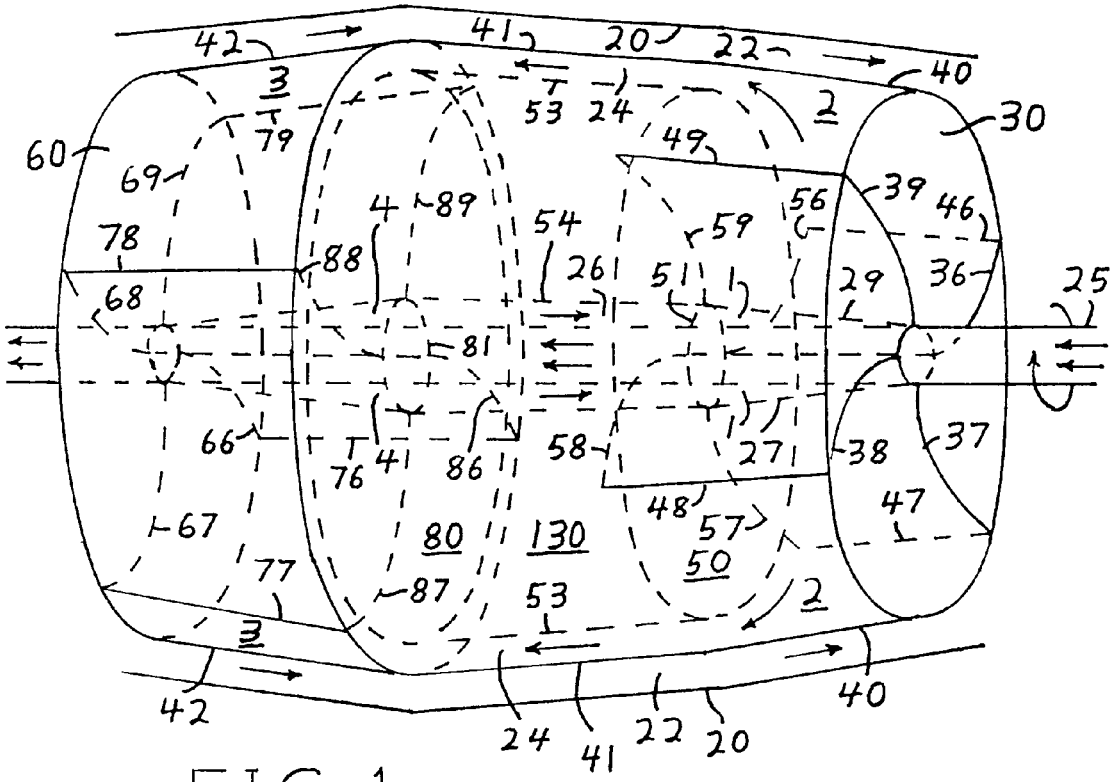
FIG. 1 shows a perspective view of a complete engine except that the heat exchangers are not shown in detail, the feedback system keyed on engine rotation is not shown, and the fluid flow is not optimized by for example adding curvature to the blade casings, thus avoiding some confusing curved lines. The figure shows two centrifugal fans and the fluid path connections between them. These paths are only suggestive and paths more like drilled holes and tubes are contemplated. Also not shown are the fins or spirals connecting the outer and inner wall of the path on which heat is added. Also, the outer container, which does not rotate, and merely contains the heating fluid, is drawn transparent to avoid confusion. Otherwise all of the lines of the rotating parts of the engine would be dotted, not solid. A modified centrifugal pump with axial discharge having a casing rotating with the blades is also shown in a primitive form in this FIG.

FIG. 1 shows a workable, but simplified version of the engine. Numbers 1, 2, 3, and 4 are reserved for points in the flow of the working fluid that illustrate the cycle through which the working fluid goes. Except for the containment sheet 20 on the top and bottom of the figure and used to direct a hot fluid in the channel labeled 22 between containment sheet 20 and sheet 41, all parts in die figure are rotating with a common angular velocity around the axis of the pipe 25 used to carry a cooling fluid, probably a high heat capacity liquid. The pipe 25 also carries the output torque of the engine.

The fairly thick metal sheet 30, which serves to hold in the working fluid, would best be concave when looked at from within the engine, near its left to right center. Curved lines 36, 37, 38, and 39 represent the intersection of fan blades with sheet 30 and would best represent a firm attachment. The curved lines and thus the blades form a spiral but die spiral, for die sake of clarity in die drawings does not go more than 90 degrees around the axis of rotation. Otherwise the spirals would be too close to each other and cause confusion in the drawing. In actual practice the spirals might wrap much further around the axis of rotation to increase pressure at the pump output.

Lines 46, 47, 48, and 49 represent the intersection of the working fluid container, a part of which is represented by the sheet 40, with the same respective fan blades and would best represent a firm attachment along those lines. Lines 56, 57, 58, and 59 represent the intersection of the respective blades with a disc 50, which is the surface of solid 130 and may be slightly convex when viewed from sheet 30. The convex shape would help direct output fluid from one fan to the other. The optimum shape for surface 50 and surface 30 will be discussed later. The blades can be firmly attached to the solid 130 at disc 50. Notice that the blades and casing to which they are attached form a rotor, which is part of a substantially centrifugal compressor. Notice also, that die same blades and casing form an impeller, which during power production impels the working fluid to increase angular momentum and velocity. More of the fluid acceleration is radial than axial, and thus the compressor is called centrifugal. It may contain elements of an axial compressor, but the centrifugal aspect predominates.

The disc stops short of the extremes of the blades, because fluid has to leave the fan area and proceed to the second fan along the channel 24 between surface 53 and the surface of sheet 41. Neither surface needs to be exactly conical and either or both may bulge somewhat Heat is exchanged across sheet 41. The exchange is between hot fluid in channel 22 and hot working fluid in channel 24. In an engine heat is added to the working fluid. The working fluid was heated by the compression due to centrifugal force and due to the fan blades. The disc 50 has a hole in the center. The perimeter of the hole is numbered 51. This hole allows fluid coming from the other fan to enter the area occupied by the fan blades just described.

Surface 54, which may be the part of the surface of solid 130 forming an inner bore, and the outside of pipe 25 form a channel 26 which conducts fluid from a second fan to the fan already described. The cool fluid in the pipe 25 exchanges heat with the cool fluid traveling between the fans in channel 26. The working fluid is cooler near the axis of rotation than it is near the periphery of the engine because the fluid has been, expanded in the second fan area and not been compressed yet in the first fan area. In an engine heat is removed from the working fluid in channel 26. In a heat pump heat would be added to the working fluid in channel 26.

Before describing the second fan, line 27 represents the fourth edge of the blade whose other three edges are 37, 47, and 57. Similarly line 29 represents the fourth edge of the blade whose other three edges are 39, 49, and 59. The fourth edges of the other two blades of the first fan are similar but their lines on the drawing both coincide in a two dimensional view with the line that would describe the axis of rotation. They are shown, by dotted lines.

The second fan is similar to the first. The sheet 60, which serves to hold in the working fluid, would best be concave when looked at from within the engine near its center. Curved lines 66, 67, 68, and 69 represent the intersection of fan blades with sheet 60 and would best represent a firm attachment. The curved lines and thus the blades form a spiral, but, for the sake of clarity in the drawing, the spirals do not go more than 90 degrees around the axis of rotation. Otherwise the spirals would be too close to each other and cause confusion. In actual practice the spirals might wrap much further around the axis of rotation to decrease pressure at the pump output near its center.

Lines 76, 77, 78, and 79 represent the intersection of the working fluid container, a part of which is represented by sheet 42, with the same respective fan blades and would best represent a firm attachment along those lines. Lines 86, 87, 88, and 89 represent the intersection of a disc 80, which is a surface of solid 130, with the same respective fan blades. The blades can be firmly attached to the disc. The disc stops short of the extremes of the blades, because fluid has to enter the fan area having proceeded from the first fan along the channel 24 between surface 53 of the solid 130 and outer sheet 41.

Disc 80 may be concave when looked at from inside solid 130 so that working fluid traveling into the fan may make a smoother transition in velocity. The optimum shape for surface 80 and surface 60 will be discussed later.

Figure 3:
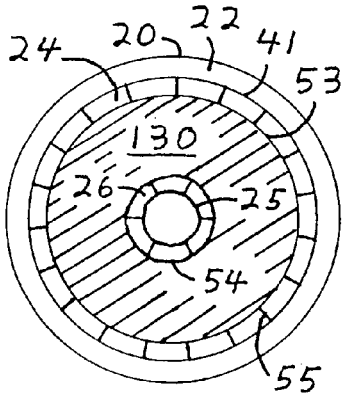
FIG. 3 shows a cross-section near the middle of the engine of FIG. 1 perpendicular to the engine rotation axis and between the two fans and viewed looking away from the compression fan.

There would be fins attached to pipe 25 and surface 54 of solid 130 to hold them so they do not move much relative to each other and also to facilitate heat exchange between the fluid in the pipe 25 and the fluid in the channel 26. These fins are not shown in FIG. 1 to prevent a clutter of lines. However they are shown in FIG. 3. There may also be heat exchange fins in the pipe 25.

There would also be fins 55 in channel 24 to facilitate heat exchange between fluid in channel 24 and fluid in channel 22. These fins are not shown in FIG. 1 to prevent clutter in the drawing and confusion. However they are shown in FIG. 3. The fins 55 could double as blades in channel 24 to meet the fluid coming from the first fan near disc 50 and bring the fluid up to me correct rotational speed while also propelling it toward the second fan. If the blades of the fan are twisted properly, the fluid may leave at close to the correct rotational rate and also traveling with a component of velocity toward the second fan.

The space between disc 80, disc 50 and surface 53 and surface 54, which I described as solid 130, may be made of solid material, so as to withstand the huge crushing pressure and also the huge pressure difference as you move radially along its surface. It may also be porous with a solid skin. The material occupying this volume must also be attached to the rest of the rotating parts of the engine so as to maintain rotation and more importantly so as to not have its center of gravity move away from the rotation axis. Attachments of itself to the sheet 41 and to pipe 25, which were discussed earlier as fins, are important in maintaining spacing and relative position. The attachments have been described above as fins in channel 24 and in channel 26.

Except for the presence of blades and fins, the points in the flow having a given axial and radial coordinate pair are equivalent independent of the amount of rotation. In FIG. 1, I have marked two equivalent positions in the flow for each of the following four points. In a typical cycle, the working fluid could be made to go from point 1 near the axis of rotation to point 2 thus compressing the fluid and heating it. The fluid could then travel along channel 24 while heat is added to it by heat exchange with the fluid in channel 22. The fluid arrives at point 3 heated and then travels through the expander to point 4. It expands cools and provides mechanical energy to the blades while in the expander. It then travels along channel 26 back to a point similar to point 1 while being: cooled by heat exchange with the fluid in pipe 25.

This cycle could be caused to happen in ways other than using a fan compressor and a fan expander. Consider a metal tube accompanied by proper structural supports, and shaped and rotated and heated and cooled as needed to carry a fluid along the actual physical and temperature path of the working fluid as described in the preceding paragraph. This contraption would act like an engine. The energy loss in the engine would be mainly from the pressure drop due to fluid flow within the tube. The biggest problem would be how to add heat at the points furthest from the rotation axis, and how to remove heat at the points closest to the rotation axis.

As a matter of fact, in the engine shown n FIG. 1, the paths between the fans are topologically equivalent to tubes, and each fan is topologically equivalent to a set of parallel tubes (in the sense of electrical wires being in parallel when considering flow).

Figure 2:
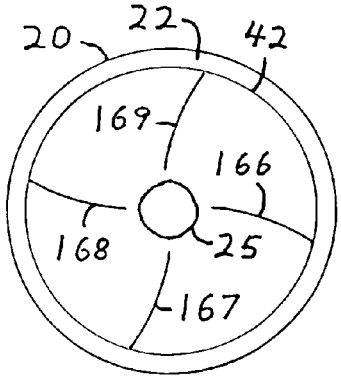
FIG. 2 shows a cross-section near the left end of the engine of FIG. 1 perpendicular to the engine axis and through the center of gravity of the expansion fan and viewed looking away from the compression fan.

FIG. 2 shows a cross-section of the expander shown in FIG. 1, perpendicular to the rotation axis and through the center of gravity of the expander and viewed looking toward container sheet 60 and away from container sheet 30. The blades 166, 167, 168, and 169, whose respective connections with container part 60 were labeled in FIG. 1 as 66, 67, 68, and 69, are shown as stopping short of pipe 25. They can actually continue to the pipe if desired. There would be some heat loss traveling along the blades to or from the pipe. Sheet 42 is an outer part of the working fluid container and the blades are shown connected to it. Heat loss along the blades fed by heated sheet 42 will add some to energy output, but not efficiency. Channel 22 carries die fluid providing input heat to the engine. It is bounded on the outside with containment sheet 20, which does not rotate with the rest of the engine.

FIG. 3 shows the fluid paths between the inputs and outputs of the two fans shown in FIG. 1. It is a cross-section of the engine of FIG. 1 taken perpendicular to the rotation axis and substantially equidistant between the two fans and viewed looking toward container sheet 60 and away from container sheet 30. Pipe 25 in the center is a continuation of itself also shown in FIGS. 2 and 4 and in FIG. 1. It supports the engine physically and carries the output engine torque to the user of the engine. It also carries the cooling fluid, probably a liquid. Channel 26 carries working fluid between the two fans. Since it touches pipe 25 the fluid gives up heat to the pipe, while the fluid travels between the fans. Surface 54 of solid 130 is an outer boundary of channel 26 and is also the innermost boundary of solid 130 whose outermost boundary is surface 53. There should be braces or some means to carry torque between the pipe 25 and solid 130 and those braces can also act as heat exchange fins connected to the pipe for good heat transfer. These braces doubling as fins were also mentioned in the discussion of FIG. 1. They are shown in FIG. 3 but not in FIG. 1, because they would add to the clutter of lines at the center of FIG. 1.

Channel 24 carries working fluid from one fan to the other. It is bounded by surface 53 of solid 130 and by sheet 41. Fins 55 which also act as braces and blades are located in channel 24. As fins they aid heat exchange between the fluid in channel 22 and the working fluid in channel 24. As braces they minimize relative motion between sheet 41 and solid 130. As blades they urge the working fluid to travel from the compressor fan to the expander fan. They simultaneously increase the angular momentum of the working fluid. Containment sheet 20 forms an outer boundary for fluid flowing in channel 22. Containment sheet 20 also serves as a shield in case the engine explodes. The engine should be kept at a safe operating speed. Since there is almost no bending or changing stress on engine parts during operation they should have little metal fatigue.

Figure 4:
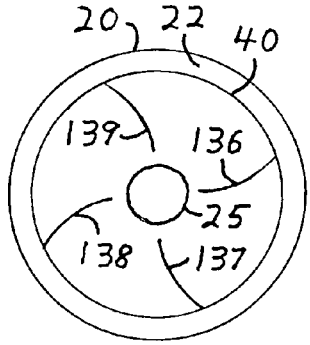
FIG. 4 shows a cross-section near the right end of the engine of FIG. 1 perpendicular to the engine axis and through the center of gravity of the compression fan and viewed looking toward the expansion fan.

FIG. 4 shows a cross-section of the compressor shown in FIG. 1, perpendicular to the rotation axis and through the center of gravity of the compressor and viewed looking toward container sheet 60 and away from container sheet 30. The blades 136, 137, 138, and 139, whose respective connections with container sheet 30 were labeled in FIG. 1 as 36, 37, 38, and 39, are shown as stopping short of pipe 25. They can actually continue to the pipe if desired. There would be some heat loss traveling along the blades to or from the pipe. Sheet 40 is an outer part of the working fluid container and the blades are shown connected to it. Heat loss along the blades from heated sheet 40 will add some to energy output, but not efficiency. Channel 22 carries the fluid providing input heat to the engine. It is bounded on the outside with containment sheet 20, which does not rotate with the rest of the engine.

The engine can be manufactured in many ways and this would be left to the engineers. One way that appears good to me is to construct the two halves of the engine separately. Divide the engine into two parts to be connected later at the cross-section shown in FIG. 3. When cut in this way all of the metal parts are accessible from this cut. Also all of the spaces to be occupied by the working fluid are accessible from this cut. This would allow casting, if the pouring is done in a vacuum.

If most of the parts are not cast as a single unit, then it is best to leave sheet 40 off, as a path for the welder, until the blades are attached to sheet 30 and surface 50 of solid 130. It would also be best to leave sheet 42 off until the other set of blades is attached to sheet 60 and surface 80 of solid 130. In each case the welder could be inserted through the eventual location of sheet 40 and sheet 42. This manufacturing technique would imply that solid 130 would consist of two parts one on each side of the cross-section shown in FIG. 3. Any working fluid that eventually seeps between the two halves of solid 130 would cause no serious problem.

As the engine is drawn, the torque on pipe 25 due to fluid reaction in the compressor when viewed from the extreme right of the figure is counter-clockwise. The torque on pipe 25 due to fluid impelling the blades in the expander when viewed from the far left is also counter-clockwise. Thus the two sections of pipe meeting at FIG. 3 could screw together so that those torques would tend to screw it tighter. The threads would be counter to the normal threading (which assumes that both parts are coming in clockwise looking toward the junction). If the drawing had been reversed, so the expander and compressor interchange positions while keeping the rotation the same, or if the blade spirals and rotation were reversed, then the screws should have normal threading, tightening clockwise. An arc welder or maybe a laser welder using a light pipe could be inserted along the inside of the pipe and thus the two sections of pipe could be welded together. Of course screw threads could be employed at various distances from the rotation axis.

Looking at FIG. 3 fins between the pipe and solid 130 should be attached to the pipe producing good heat transfer before the solid 130 is added. Welding of fins in channel 26 to solid 130 could take place using a welder inserted parallel to the rotation axis. For good heat transfer, fins 55 shown in FIG. 3 should be attached to sheet 41 before it is placed around solid 130 and those fins should be welded to solid 130 afterward. Again, the welder could be inserted into channel 24 parallel to the rotation axis from the cut made by the cross-section of FIG. 3. Any fins that would extend into channel 22 could be attached to sheet 41 before or after placing it around solid 130. Since the blade casings sheet 40 and sheet 42 extend further from the rotation axis than solid 130 does, in each case there is room between the casing and the solid 130 to insert a welder to weld the blades to the sheets 40 and 42 as long as sheet 41 is attached later. None of the above is to imply that other forms of welding or of connecting parts or of casting could not be used to build the engine. Also, there is no order in which the operations must be done.

In order to put working fluid into the engine after construction, while a valve could be attached near the axis on sheet 30 it might be best to simply use two access ports located on opposite sides of the rotation axis. The engine would be placed in a pressurized chamber containing the working fluid to be added to the engine. These access ports can be permanently sealed after the working fluid is injected, since no fluid is likely to leak after die ports are closed.

The use of two ports brings up the fact that because of the high rotation rates there should be balancing, so the engine does not vibrate. Any valve or port, preferably placed near the axis of rotation, must be accompanied by opposing balancing weight. The engine as a whole should be put on a balancer and weights should be added to balance as necessary. Maybe a fake weld can be added to the outside.

To optimize flow and thus minimize loss associated with localized circulations and turbulence, there should be a relatively smooth transition of the axial component of relative velocity of the flow as it enters, travels through, and leaves each fan. Consider a plot of the position of a small volume of working fluid, to be referred to within this paragraph as "the position", as the small volume of working fluid travels through the engine. Use the component of the position parallel to the rotation axis as the X coordinate and use the distance of the position from the axis as the Y coordinate. We are ignoring the rotational angle around the axis. As the position travels along channel 26 the fluid is cooled and has a large and slowly varying velocity in the +X direction. When it leaves the vicinity of the center hole of disc 50, a surface of solid 130, it starts into the compressor. While in the compressor the velocity of the position gradually decreases in the +X direction but increases in the +Y direction. To facilitate this rotation in direction, a tangent to the surface of solid 130 nearest the position can be almost parallel to the velocity of the position of the small volume of working fluid. This tangent starts out nearly parallel to the rotation axis. Somewhere near the middle of the compressor, the velocity of the position is nearly all in the +Y direction. Thus, in a plane containing the axis of rotation, the direction of the surface of solid 130 near the middle of the compressor should therefore be in the +Y direction, equivalently perpendicular to the rotation axis. Shortly after leaving the compressor and entering channel 24 near the periphery of disk 50, the position is traveling in the −X direction. Thus to follow the position, the tangent to the surface of die solid 130 will have rotated smoothly to follow the velocity of the position. The net result is that the surface of solid 130 looks similar to a semi-circle in the (X,Y) coordinate system.

Actually, since the position can have only positive components, die real three dimensional surface of solid 130 must be found by rotating the surface curve obtained in the (X,Y) coordinate system around the rotation axis, thus producing a surface for solid 130 looking like the surface of a half bagel obtained by slicing through the bagel's center perpendicular to the axis of rotational symmetry.

This configuration and a similar configuration for sheet 30 would produce relatively smooth flow, but sheet 30 would have to be anchored extremely well to the pipe 25 and to the blades or it would need reinforcement to overcome the extreme pressure forces due to pressure of the working fluid. Also a compromise has to be made to get good pumping efficiency, since the pump works best in a region in which the blades are pushing the fluid with a large radial component. The radial component is reduced when the fluid is traveling with a large X component in its velocity.

Correctly shaped and oriented blades can continue to increase pressure of the working fluid, even when the velocity has lost most of its Y component. The fan behaves somewhat like an axial compressor when the Y component is very small. The radial compressor aspect has a huge advantage over the axial compressor aspect, since the radial is helped by the very large rotational speed of the engine. Even at low working fluid flow fates, there is a huge contribution to pressure differences made by the centrifugal forces. Because surfaces 50 and 80 and surfaces 30 and 60 are shown as flat in FIG. 1, this emphasizes the radial pumping aspect at the expense of the smooth flow aspect of the engine. Some compromise must be made. The flat surfaces also made the description of the figure much easier to follow.

When looking at operating temperatures in designing for efficiency, the following must be taken into account. The output of the engine, minus losses, is the difference between output energy of the expander and that energy needed to compress the fluid. For small differences this difference will grow proportionally to the temperature difference induced in the working fluid while traveling along channel 24, in other words along the high temperature heat exchanger. If we start with a given size compressor, then when we have low temperature difference along the heat exchanger, the corresponding expander should be of similar size and the sum of losses in the compressor and expander will be about twice the compressor loss. At first as we increase temperature difference the loss remains almost constant. Thus, the energy output increases proportionally to the temperature difference. However, if the temperature difference is sufficiently large (like in a jet engine or an internal combustion turbine), then the compressor loss becomes small compared with the expander loss, and loss becomes proportional to energy output.

Assume operation at the high temperature heat exchanger between 900 degrees absolute output and 800 degrees absolute input on the Kelvin scale with a similar ratio at the low temperature end say between 400 degrees and 350 degrees. Then the theoretical maximum efficiency becomes approximately (850−375)/850=55.9%. Also the temperature ratios in the compressor and expander must be about 800/350=2.286 or about 900/400=2.25 to 1. If a perfect engine operated between two heat sinks at a ratio of temperatures between these two ratios, then its efficiency would be 56%. The ratio within each fan is approximately equal to the temperature ratio between the averages in the heat exchangers. Even if most of the compression and expansion is done using centrifugal as opposed to pumping blade forces, the efficiency of the compressor and the expander can be very high. Do calculations using maraging steel for the compressors and Krypton for the working gas.

The following describes an embodiment of my favorite design for die engine of the current invention. Assume an engine comprising a steel cylinder 24 inches long of 11 inches inside diameter and 12 inches outside diameter. Holes parallel to the cylinder length and ⅛ inch below the outer diameter are drilled. If desired, the holes can be produced by routing the inside of an outer sheath and the outside of the peripheral cylinder and welding the two together. Each hole has ⅛ inch diameter. The engine also comprises a substantially centrifugal compressor that exhausts into the holes, and another similar substantially centrifugal compressor acting as an expander that receives working fluid from those holes. The working fluid is krypton. Fluid diodes, such as a funnel shape, pointing toward the expander can be included for each hole to discourage back flow. The expander has radial vanes. The other compressor has vanes that are slightly retrograde so as to start fluid circulation when the engine is accelerated. The retrograde vanes also encourage the fluid circulation when the engine is maintaining the same rotation rate, because, as the fluid moves outward the vanes are moving faster at the larger radius and thus push against the slower moving fluid. The normal to the retrograde vane surface pushing the fluid has a positive component in the radial direction and thus encourages fluid circulation.

The engine also comprises a center pipe parallel to the cylinder and a group of tubes that carry a cooling liquid along the inside of the pipe. See FIGS. 5, 6, and 7 to understand the description of this region. In the region between the expander and compressor, the space between the pipe and the outsides of the tubes picks up fluid from the center of the expander and carries it through the center pipe to the compressor. In other words, the expander and compressor each connect to the pipe between them. The cylinder, the two compressors, and the center pipe and tubes being described in this paragraph are all physically connected and rotating as a group around the center line of the pipe.

Figure 7:
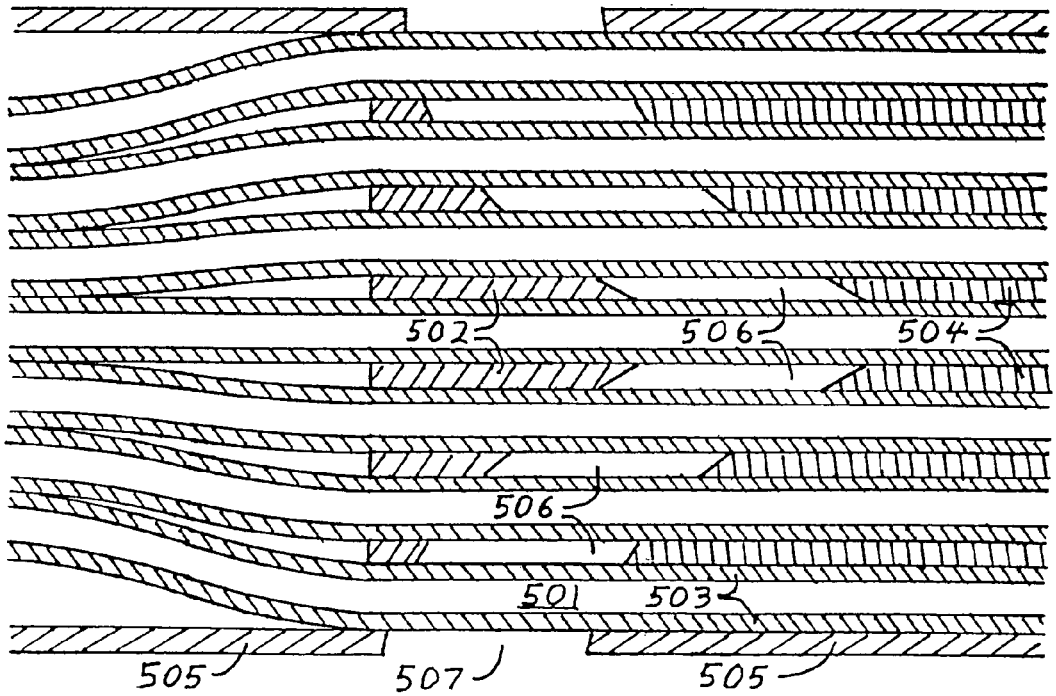
FIG. 7 shows the larger diameter pipe and the tube-plug assembly within it. This only shows a region near the expander. The region near the compressor could look like a "mirror" image with the point of symmetry being at the center of the pipe midway between the expander and compressor.

A plug through which the tubes extend is situated at each compressor. The plug at the expander is shown in FIG. 7 and is numbered 502. It is shaped to provide relatively smooth flow of the working fluid as it leaves the expander and enters the space inside the center pipe but outside of the tubes, while heading for the compressor. The plug at the compressor is similarly shaped and provides smooth flow as the working fluid leaves the space outsides the tubes but inside the pipe and enters the compressor. The tubes travel within the center pipe, which has a 4 inch inside diameter.

Figure 5:
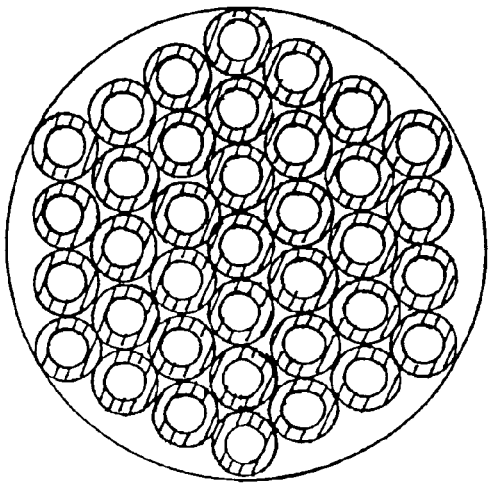
FIG. 5 shows a cross-section of cooling tubes pressed together and the pipe containing them. This is located just to the left of the far left portion of FIG. 7.

Between the two compressors the working fluid travels outside the tubes but inside the center pipe while a cool liquid travels inside the tubes. Outside the area between the compressor and expander the cooling liquid travels first in the whole of a smaller diameter pipe, just large enough to contain the tubes, as shown in FIG. 5 and then through the tubes up to the plugs. FIG. 5 shows the cross-section shortly before reaching the leftmost part of FIG. 7. The pipe of FIG. 5 is not shown in FIG. 7, but is connected to the pipe shown in FIG. 7. The two pipes share the same center line. The tubes are still pressed together at the left of FIG. 7 but diverge to be separated from each other at the plug. In FIG. 7 the pipe 505 is shown having two sections one before and one after the entry 507 from the expander. A continued fluid path 506 carries the fluid from the expander. Some fluid passes the outer tubes, to surround the central tubes. Fins 504 are connected to the outsides of the tubes. They start on the side of path 506 away from the plug 502. The fins help with heat exchange and also help keep the spacing between tubes constant.

The plug-tube assembly can be manufactured separately and the plugs would later be welded to the pipes. Because the plugs and pipe sections would be rotating, it was deemed best to use a smaller inside diameter for the pipes which are not between the compressors, but expand the cross-section as the plugs are approached. As mentioned earlier, the tube bundle would start within the smaller pipe with each tube touching neighboring tubes. They would then separate after leaving the smaller pipe so there is more space between the tubes at the plugs and between the compressors. A series of funnels could be supplied each leading to a tube end to provide smoother flow from the smaller pipe to the tubes. The cooling liquid would be spun up before reaching the funnels before the first plug and then spun back down after the second plug probably using fins, so some of the rotation energy could be recovered by the engine and so the spin up could help to increase flow of the liquid.

Figure 6:
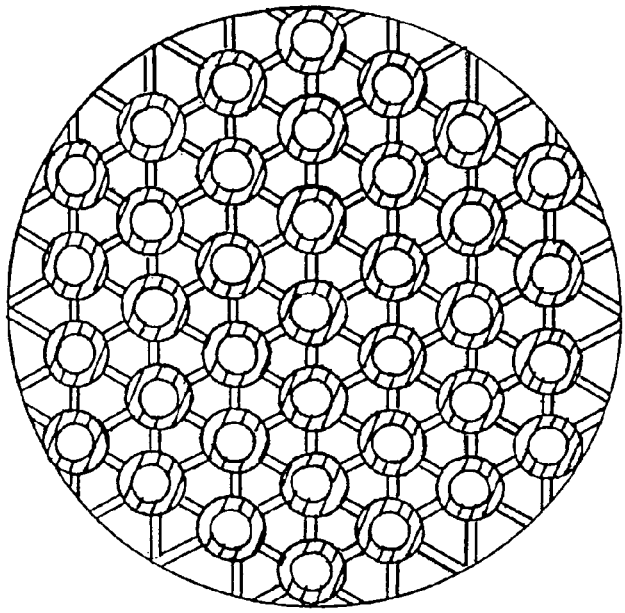
FIG. 6 shows a cross-section of the same, tubes as in FIG. 5 but spread out within the pipe of larger diameter. This is located in the far right portion of FIG. 7.

FIG. 6 shows the fins and tubes as they are arranged between Hie compressors. For the particular case shown, my suggested method of construction is first attach the tubes in a vertical chain. In this case a chain of 4, of 5, of 6, of 7, of 6, of 5, and of 4 tubes. All vertical fins are now accounted for and attached to their tubes. Now attach the non-vertical fins to the vertical 4, 6, 6, and 4 tube chains. This step could have been done before or while the vertical even numbered chains were formed. This accounts for all remaining fins, except for the two fins at the top and two at the bottom of the chain of 7 vertical tubes. Finally, fins only touching vertical chains of 5, 7, and 5 would now be welded to these. All tubes and fins shown in FIG. 6 are now attached. Be sure that the fins end at the spaces labeled 506 in FIG. 7. All fins touching the pipe could be welded to the pipe after the tube assembly is inserted. This method could be generalized with minor modifications to use larger or smaller numbers of tubes.

If the heat is introduced into an engine by a flow of hot gas, it would be best to spin the hot gas up to cylinder rotation and back down again. For example, one method would be to have a layer just outside the compressors and cylinder, in which layer the hot gas is spun up to cylinder rotation speed, as it travels along the outside of the expander, and spun back down again, as it travels along the outside of the compressor, to recapture most of the rotation energy. This spin up, heat exchange, and spin down, would act like a low efficiency reverse engine, because the heat is being removed from the flow at the periphery. The hot gas would be lighter molecules than krypton thus reducing the pressure ratio. The hot gas would also be diatomic nitrogen and oxygen, and triatomic carbon dioxide in the case of combustion (thus having a lower heat capacity ratio leading to a lower ratio between the temperature ratio and the pressure ratio). The two effects would produce very low efficiency in the reverse engine, which is what we want, because it subtracts from actual engine output Carbon dioxide for example has a heat capacity ratio of 9/7, while nitrogen has a heat capacity ratio of 7/5, whereas the noble monatomic gases have a heat capacity ratio of 5/3. The rotating outer shell of the hot gas carrier would be encased in a stationary outer shell. The space between the two shells would be evacuated to decrease drag and heat loss.

It would also be possible to use a separate heat exchanger to heat a liquid, which liquid would be spun up and spun down replacing the hot gas mentioned in the previous paragraph. In this case there would be no reverse engine effect. Flow rates could be optimized. If solar collecting tubes are used, then the hot liquid might be the solar collector tube output and the hot liquid exhaust from the engine could be sent back to the collector tube.

The invention claimed is:

1. A device comprising a working fluid contained in said device, a first compressor, a first expander to produce power from the working fluid flow, a unidirectional flow traveling all the way from said first compressor to said first expander, said unidirectional flow being continuous and at substantially constant speed at most, if not all, reference points, during several cycles of device operation when the device is operating substantially at constant speed in the preferred operating range of speed, said reference points being stationary with respect to the engine, said unidirectional flow traveling in a first fluid connection to carry said first unidirectional flow, which connection communicates between the output of said first compressor and the input of said first expander, a second unidirectional flow traveling all the way from an expander to said first compressor, said second unidirectional flow being continuous and at substantially constant speed at most, if not all, reference points, during several cycles of device operation when the device is operating substantially at constant speed in the preferred operating range of speed, said reference points being stationary with respect to the engine, said second unidirectional flow traveling in a second fluid connection to carry said second unidirectional flow, which connection communicates between the output of this expander and the input of said first compressor, said working fluid being thus free to travel from said an expander to said first compressor and then from said first compressor to said first expander without being able to leave the said device, said unidirectional flows being operative substantially all of the time during long operational periods each period being sufficient to circulate the same atoms of working fluid to pass through said first fluid connection many times, a means located along said first fluid connection to exchange heat in a first direction of heat flow between said working fluid and some system outside of said working fluid while said working fluid is flowing in said first connection, a means located along said second fluid connection to exchange heat in the opposite direction to said first direction of heat flow between said working fluid and some system outside of said working fluid while said working fluid is flowing in said second connection, said working fluid being contained in said device, so that, except for minor leaks, none of the fluid escapes from the device during device running times, the temperature of said working fluid during the optimum operational range being cycled such that the temperature change from input to output of the said first compressor and the temperature change from input to output of the said first expander are both significantly larger in magnitude than both the magnitude of the temperature change of the working fluid while traveling in said first fluid connection and the magnitude of the temperature change of the working fluid while traveling in said second fluid connection, thus making it unnecessary to use a regenerator connected to either of said fluid connections.

2. The device of claim 1 wherein said first direction for heat exchange adds heat to the said working fluid, while going from compressor to expander, and wherein said opposite direction for heat exchange subtracts heat from said working fluid.

3. The device of claim 1, wherein the said working fluid is both more than 70% the weight of air at the same temperature and pressure and also at least 30% monatomic, meaning a significant fraction of the working fluid molecules are single atoms, as opposed to air, the molecules of oxygen and the molecules of nitrogen in air being diatomic, air also naturally containing 1% Argon.

4. The device of claim 1 wherein said first compressor is a substantially centrifugal compressor thus having a flow input near its center near its impellor rotation axis and a flow output near its periphery away from its impellor rotation axis, which uses power, said first expander is a second substantially centrifugal compressor to be used as an expander having reverse flow and thus having a conventional flow input, actual flow output, near its center near its impellor rotation axis and having a conventional flow output, actual flow input, near its periphery away from its impellor rotation axis, said first and second fluid connections being such that normally during constant device speed when a substantial conventional flow of said working fluid is taking place in the said first compressor a reverse flow of said working fluid is taking place in the said first expander which is really a second substantially centrifugal compressor to be used as an expander, thus making the second compressor's conventional flow output near its periphery an actual flow input and making its conventional flow input near its center an actual flow output.

5. The device of claim 4, wherein the blades of said first substantially centrifugal compressor are attached to solid sheathing so that both edges of each blade move with their immediate surroundings, thus they do not sweep along any surface as is common for most blades in current centrifugal pumps.

6. A device comprising a working fluid contained in said device, a first compressor, a first expander to produce power from the working fluid flow, a unidirectional flow traveling all the way from said first compressor to said first expander, said unidirectional flow being continuous and at substantially constant speed at most, if not all, reference points, during several cycles of device operation when the device is operating substantially at constant speed in its preferred speed range said reference points being stationary with respect to the engine, said unidirectional flow traveling in a first fluid connection to carry said first unidirectional flow, which connection communicates between the output of said first compressor and the input of said first expander, a second unidirectional flow traveling all the way from an expander to said first compressor, said unidirectional flow being continuous and at substantially constant speed at most, if not all, reference points, during several cycles of device operation when the device is operating substantially at constant speed in its preferred speed range said reference points being stationary with respect to the engine, said second unidirectional flow traveling in a second fluid connection to carry said second unidirectional flow, which connection communicates between the output of this expander and the input of said first compressor, said working fluid being thus free to travel from said an expander to said first compressor to said first expander without being able to leave the said device, said unidirectional flows being operative substantially all of the time during long operational periods being sufficient to circulate the same atoms of working fluid to pass through said first connection many times, a means located along said first fluid connection to exchange heat in a first direction of heat flow between said working fluid and some system outside of said working fluid while said working fluid is flowing in said first connection, a means located along said second fluid connection to exchange heat in the opposite direction to said first direction of heat flow between said working fluid and some system outside of said working fluid while said working fluid is flowing in said second connection, said working fluid being contained in said device, so that, except for minor leaks, none of the fluid escapes from the device during device running times, said working fluid both being more than 70% the weight of air at the same temperature and pressure and also being at least 30% monatomic, meaning a significant fraction of the working fluid molecules are single atoms, as opposed to those of air, the molecules of oxygen and the molecules of nitrogen in air being diatomic.

7. The device of claim 6 wherein the exchange of heat in said first direction adds heat to the said working fluid and wherein the exchange of heat in the opposite direction subtracts heat from said working fluid with said working fluid temperatures during the optimum power production range being cycled such that the temperature change from input to output of the said first compressor is significantly larger in magnitude than both the magnitude of the temperature change while traveling in said first fluid connection and the magnitude of the temperature change while traveling in said second fluid connection.

8. The device of claim 6, wherein, at all times during device operation in the preferred range of speed, there is an unobstructed fluid path within said working fluid, said path starting at the entrance of said an expander and traveling through the expander and traveling within said second fluid connection to the entrance of said first compressor and then traveling through said first compressor and then traveling within said first fluid connection from the exit of said first compressor to the entrance of said first expander.

9. A device for converting between heat energy and mechanical energy comprising a working fluid, at least one compressor said compressor containing a rotor with blades to propel a fluid, at least one expander said expander containing a rotor with blades to convert fluid motion to rotation of the rotor, at least one heat exchanger of a set one to exchange heat in one direction of heat flow between said working fluid and a system outside said working fluid, at least one heat exchanger of a set two to exchange heat in the opposite direction of heat flow from said one direction of heat flow between said working fluid and a system outside said working fluid, said device being put together so that at any particular time during device operation in its preferred operating range said working fluid flows along a flow path through a heat exchanger of set one, then through said at least one compressor, then through a heat exchanger of set two, then through said at least one expander, this whole flow path for said working fluid being open to allow fluid to pass at said any particular time as qualified above, said working fluid flowing in a unidirectional, continuous flow the flow speed at any point in the circuit being substantially constant whenever the device is operated at a speed in the optimal speed range, said fluid being contained in said device, so that, except for minor leaks, none of the fluid escapes from the device during operation, said working fluid both being more than 70% the weight of air at the same temperature and pressure and also being at least 30% monatomic, meaning a significant fraction of the working fluid molecules are single atoms, as opposed to those of air, the molecules of oxygen and the molecules of nitrogen in air being diatomic.

10. The device of claim 9 wherein the exchange of heat in said first direction adds heat to the said working fluid and wherein the exchange of heat in the opposite direction subtracts heat from said working fluid with said working fluid temperatures during the optimum power production range being cycled such that the temperature change from input to output of the said at least one compressor and the temperature change from input to output of the said at least one expander are both significantly larger in magnitude than both the magnitude of the temperature change from end to end of said a heat exchanger of set one and the magnitude of the temperature change from end to end of said a heat exchanger of set two.

11. The device of claim 9 wherein said rotor with blades in said at least one compressor is formed by a sheathing attached to the long edges of the blades, for example each sheathing being a disc and each blade extending from one disc to the other, said rotor thus containing a set of channels, each channel being formed by two successive blades and the parts of the respective sheathings attached to the long edges of the blades and running from one blade to the other, the cross-section of each channel getting larger as the channel spirals outward, thus allowing the working gas to convert speed to pressure as it spirals outward in the centrifugal pump, the largest cross-sections near the periphery being at least three times larger than the smallest cross-sections near the rotation axis of the pump, the word cross-section being used loosely to mean the area of a surface perpendicular to the fluid flow lines.

* * * * *